United States Patent [19]

Henry, Jr.

[11] 4,069,624

[45] Jan. 24, 1978

[54] PORTABLE GRINDING MACHINE FOR RESURFACING CYLINDER HEAD RETAINERS

[75] Inventor: Rufus A. Henry, Jr., Roanoke, Va.

[73] Assignee: Stanray Corporation, Chicago, Ill.

[21] Appl. No.: 659,418

[22] Filed: Feb. 19, 1976

[51] Int. Cl.[2] ..... B24B 19/00

[52] U.S. Cl. ..... 51/241 B

[58] Field of Search ..... 51/241 S, 241 B, 241 R, 51/241 A, 245; 90/12.5

[56] References Cited

U.S. PATENT DOCUMENTS

| | | | |
|---|---|---|---|
| 2,297,074 | 9/1942 | Rohrdanz | 51/241 B |
| 2,371,465 | 3/1945 | Olsson | 51/241 B |
| 2,458,472 | 1/1949 | Irwin | 51/245 |
| 2,541,412 | 2/1951 | Frost | 51/245 |
| 2,707,358 | 5/1955 | Grunder | 51/241 B |
| 2,997,822 | 8/1961 | Lass | 51/241 B |
| 3,148,486 | 9/1964 | Gray et al. | 51/241 A |

*Primary Examiner*—Donald G. Kelly
*Assistant Examiner*—Roscoe V. Parker
*Attorney, Agent, or Firm*—Robert E. Wagner; Gerald T. Shekleton

[57] ABSTRACT

A portable grinding apparatus which refinishes the cylinder head retainer seat in an engine block to provide a surface substantially flat and square with the axis of the cylinder bore. The positioning discs are axially mounted on a central shaft, the lower of these discs enables the grinding apparatus to be initially inserted and centered within the cylinder while the upper disc is expandable within the cylinder for securing the grinding apparatus in the proper orientation for a grinding tool to refinish the surface of the cylinder head retainer seat square to the axis of the cylinder bore.

3 Claims, 6 Drawing Figures

FIG. 5
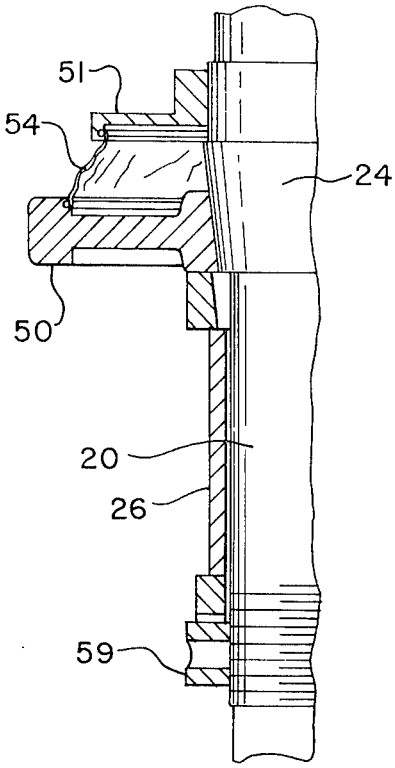
FIG. 2
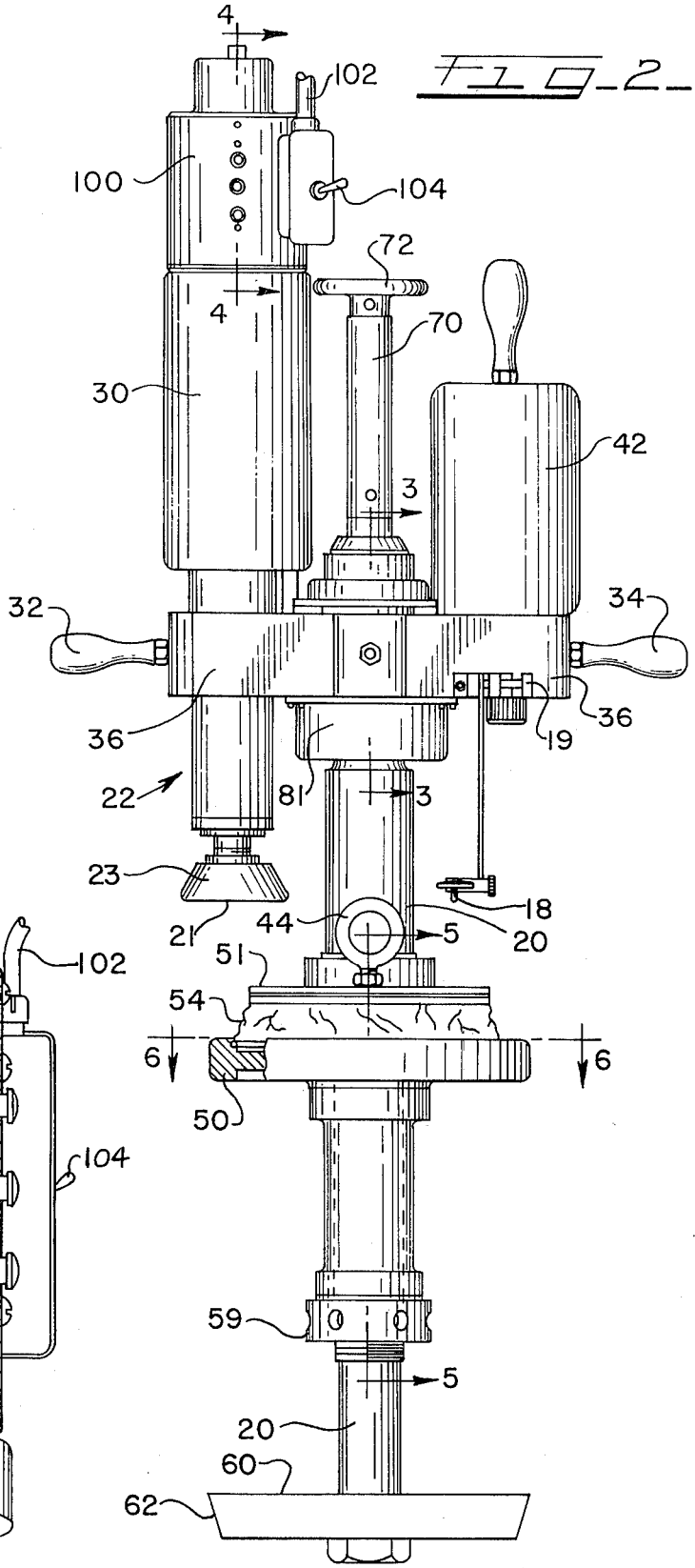
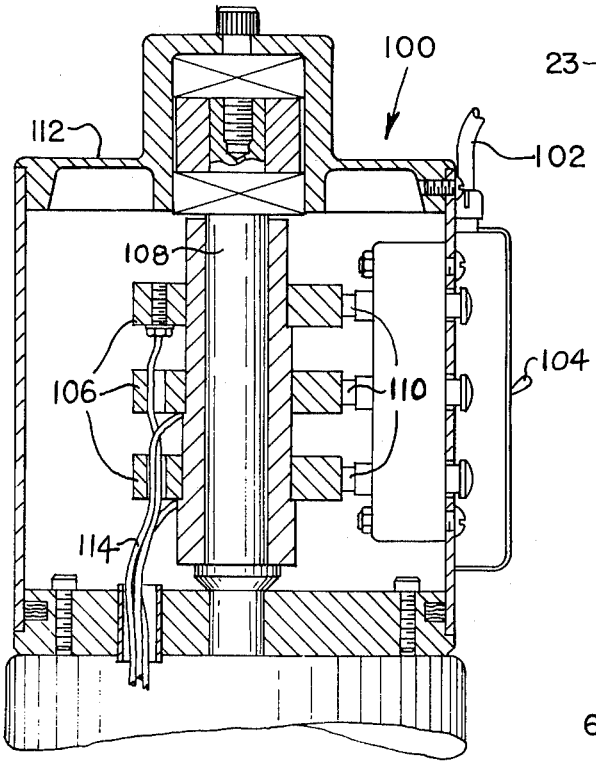
FIG. 4

PORTABLE GRINDING MACHINE FOR RESURFACING CYLINDER HEAD RETAINERS

This invention relates in general to a grinding apparatus and, in particular, to a portable engine grinder for the seat of a cylinder head retainer in diesel engines.

BACKGROUND OF THE INVENTION

In general, the engine blocks or crankcases of diesel engines, such as are used in locomotives and the like, are constructed chiefly for durability with most associated parts subjected to wear being replaceable in the basic engine block. The cylinder heads are removable and replaceable. The piston is likewise replaceable and the cylinder itself has inner walls comprising replaceable cylinder liners. The result of all these replaceable parts is that the costly crankcase encounters little wear and thus outlasts every other element of the motor which may be either in motion or in contact with moving parts and thus, subject to wear. The crankcase can thus remain in prolonged use while those parts subject to wear may be engineered for easy replacement.

Needless to say, all of the above-mentioned moving parts or parts in contact with moving parts must be precision ground to allow both freedom of movement and a positive seal with the surface with which it is in contact. Thus, it is necessary that the cylinder head seat ring present a surface to the cylinder head which is exactly square and in line with the lower bore of the crankcase. Should either the cylinder seat ring or the cylinder head retainer seat, on which the seat ring rests, be out of square, a positive seal of the cylinder head to the crankcase is not effected.

Prior to the present invention, once the cylinder head retainer seat was found to be out of square and not in line with the bore of the crankcase, it was then necessary to return the crankcase to the manufacturer for repair and replacement. This procedure was quite expensive in terms of both labor and down time of the unit under repair. In these instances the crank case had to be completely disassembled and removed from the engine mount within the locomotive or other particular vehicle. The crankcase then had to be shipped back to the manufacturer, and the vehicle being repaired had to sit idle in the repair shop waiting for the replacement crankcase from the manufacturer. Thus, much labor, plus down time and transport costs were entailed.

SUMMARY OF THE INVENTION

The subject invention alleviates these problems by allowing a crankcase to have a cylinder head seat ring seat precision ground to be exactly square with the lower bore of the crankcase while the crankcase is still mounted in the vehicle, thus allowing the down time of the vehicle to be kept to a minimum and the labor involved in repairing such vehicles to be also kept to a minimum.

The portable engine block grinder assembly of the subject invention is lightweight, easy to manipulate and can accommodate extremely precise tolerances, down to a 0.001 inch difference in the grinding surface.

The subject invention comprises a rotatable and vertically adjustable grinding stone for rotating about a central axis. The axis itself is a shaft which has two positioning discs at its lower end. These two discs orient the grinder so that the vertical axis of the machine is parallel with the power assembly. The bottom disc is tapered and closely approximates the inside diameter of the crankcase bore into which it is inserted. Between the two discs is an adjustment collar which, when turned, expands the upper or expansion disc so that the grinder is tightly held in its position relative to the crankcase head retainer.

Once the assembly is properly oriented and locked in placed by the two positioning discs a dial indicator is rotated about the seal to determine the amount of seat material that should be removed to obtain a perfectly flat seat which is perpendicular to the lower liner bore of the crankcase. Upon determining the amount of material to be removed, the grinder is rotated around the seat to the desired depth so that all portions of the seat are ground to obtain the level surface. The grinder is fed into the seat slowly until the entire seat has the desired finish. After this operation, the seat is ready for a new seat ring and the subsequent installation of the cylinder head.

An object of this invention therefore, is an apparatus for the precision grinding of a cylinder head retainer seat of an engine crankcase to furnish a level seat perpendicular to the plane of the lower liner bore of the crankcase.

A further object of the invention is a grinding wheel adjustably rotatable about an axis to allow a predetermined amount of a cylinder head seat to be ground, thereby attaining a level surface on the seat which is precisely perpendicular with the lower liner bore of the crankcase.

DESCRIPTION OF THE DRAWINGS

Further objects of the invention together with additional features contributing thereto and advantages accruing therefrom will be apparent from the following description of one embodiment of the invention when read in conjunction with the accompanying drawings wherein:

FIG. 2 is a side view of the subject invention having a partial cross section showing the means of expansion of the upper positioning disc;

FIG. 4 is a cross section of the rotatable power connection of the subject invention taken along the lines 4—4 of FIG. 2; and, FIG. 5 is a cross section of the expansion disc taken along the lines of 5—5 of FIG. 2.

DESCRIPTION OF THE INVENTION

Figures 1, 3, 6:
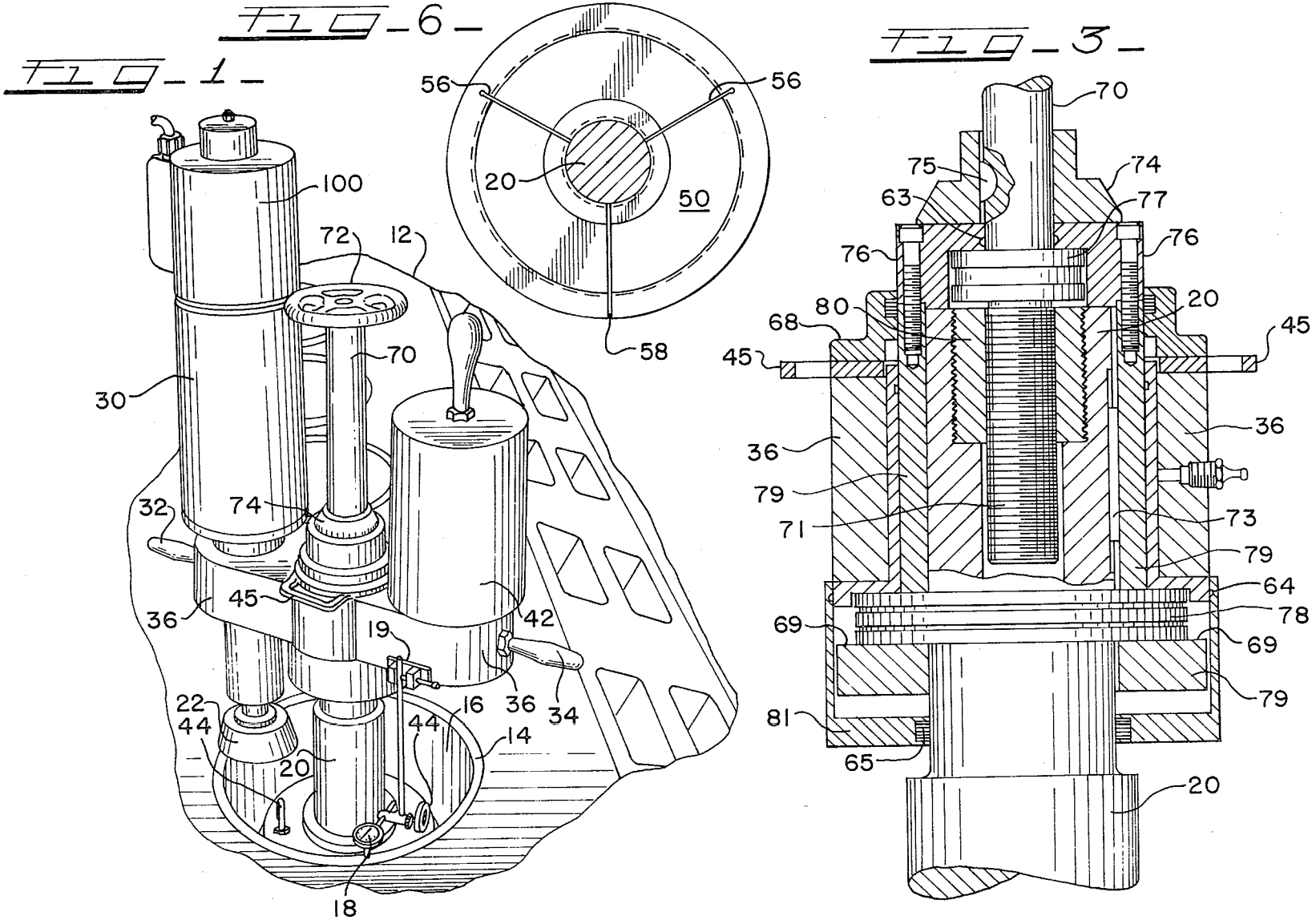
FIG. 1 is a side plan view of the subject invention shown in the operation of grinding a cylinder head seat.
FIG. 3 is a cross section of the central shaft of the subject invention taken along the lines 3—3 of FIG. 2.
FIG. 6 is a cross section of the expansion disc taken along the lines 6—6 of FIG. 2.

Referring now to FIG. 1, there is shown the apparatus 10 of the subject invention as used in grinding a cylinder head retainer seal 14 of the crankcase 12. As can be seen, the grinding wheel 22 rotates about the central shaft 20 of the subject invention thereby accurately refinishing the cylinder head retainer seat square to the crankcase bore.

FIG. 2 shows the subject invention in more complete detail. The central shaft 20, at its power portion thereof, has two positioning discs 50 and 60 attached thereto.

The lower positioning disc 60 initially orients the assembly 10 within a cylinder crankcase having an out of square retainer seat in need of repair. This lower positioning disc 60 has slightly tapered sides 62, exaggerated in FIG. 2 for emphasis, so that the disc 60 may be easily inserted into the crankcase, and yet maintain a close clearance with the crankcase walls to enable the positioning disc 60 to maintain a reasonably secure fit within the crankcase; while at the same time providing a means for self-centering the shaft 20 within the crankcase.

The upper positioning disc 50 is an expansion disc as better shown in FIG. 5. This expansion disc 50 has two expansion slits 56 extending from the center opening to a point on the outer periphery of the disc 50. A third expansion slit 58 extends from the outer perimeter to the center opening. These expansion slits 56 and 58 divide the expansion discs 50 into equal thirds in such manner that when the expansion disc is forced over the tapered portion 24 of the central shaft 20, the expansion disc 50 will expand slightly. Thus, upon turning the adjusting collar 59, the sleeve 26 is pushed up, which in turn forces the expansion disc 50 up onto the tapered portion 24 of the central shaft 20 causing the expansion disc to expand and lock the assembly 10 into the proper orientation with the cylinder. A dust cover 54 protects the junction of the expansion disc 50 and the tapered portion 24 of the central shaft 20 from the harmful wear caused by dirt, etc. Further, no dirt is thereby allowed to enter the expansion slits 56 and 58 which might cause difficulty in contracting the disc 50 preceeding removal of the assembly.

Thus, when the assembly 10 is inserted into a crankcase initially oriented by the lower disc 60, the adjusting collar 59 rotated, the expansion disc 50 pushes upward against the tapered portion 24 and expands against the crankcase walls, locking the entire assembly 10 into place within the crankcase in the proper orientation. The grinding wheel 22 is then presented at such an attitude relative to the engine block seat that it may grind the seat 14 to a surface perfectly square with the power assembly bore.

In grinding the cylinder head seat 14, a powered grinding tool 22 is utilized which rotates about the axis of the cylinder center represented by the center of the central shaft 20, when the assembly 10 is locked into the proper position in the manner described above. A grinding wheel 23 attached thereto engages a working face 21 with the seat 14 of the crankcase 12 and which, in operation, abrasively refinishes that surface upon complete rotation thereof about the axis of the central shaft 20. The grinding tool 22 is powered by a conventional motor 30 which is supported by the cross bar 36. This cross bar 36 rotates around the central shaft 20 in a manner to be described. Attached on either side of the cross bar are handles 32 and 34 for facilitating the rotation of the grinding tool. On the side of the cross bar opposite the grinding tool is seated a counter weight 42. This counter weight 42 balances the weight of the powered grinding tool and with the additional handle 40 on the top of the counter weight 42, manipulation of the entire assembly does not require great dexterity. The entire cross bar 36 and its accessories, both the counter weight 42 and the grinding tool 22, are adjustable vertically by turning the hand wheel 72.

FIG. 3 shows the manner by which this vertical adjustment is achieved. A turn of the hand wheel 72 rotates the shaft 70. The lower portion 71 of the shaft 70 is formed with a micrometer thread. This threaded portion 71 is screwed into an insert 80 which itself is fixedly attached in the interior of the central shaft 20. Immediately above the threaded portion 71 of the adjusting shaft 70 and secured thereto is a thrust bearing 77. A collar 76 is placed over thrust bearing 77 and attached to a sleeve 79. The sleeve 79 fits around and is adjustably secured by a key 73 to the central shaft 20 for movement in a vertical plane only. This sleeve 79 has a shoulder 69 upon which rests thrust bearing 78, secured to the shaft 20. For upward travel of the cross bar 36 and associated elements, the feed adjusting means 70 is rotated by means of the hand wheel 72, bringing the thrust bearing 77 to bear against the collar 76, pushing it upward. By means of the attachment of the collar 76 to the sleeve 79, this action pulls the thrust bearing 78 up and, together, the thrust bearings 77 and 78 displace the cross bar 36 and associated elements upward along the central shaft 20. When rotating the feed adjustment means 70 for downward travel the thrust bearing 78 drags the sleeve 79 downward which, through its attachment to the collar 76, pulls the thrust bearing 77 downward and, in concert, the thrust bearings 77 and 78 cause the cross bar and associated elements to travel downwardly along the central shaft 20. Dust covers 68 and 81 cover the upper and lower areas of this vertical adjusting mechanism. An increment dial 74 is attached to the feed adjusting means 70 by means of a key 75. This increment dial 74 provides indicia, which allows the operator to correctly measure the amount of travel of the power grinding tool to within .001". Of course, suitable seals in the nature of O-rings and the like are provided to prevent the entry of dust and other fouling material into the mechanism such as at 63, 64 and 65.

On the cross bar 36, underneath the counter weight 42 and opposite the powered grinding wheel assembly, is attached a depth indicator mount 19 to which an indicator 18 is attached. Indicator 18 comprises a gauge which measures the amount of distortion in the engine block seat 14 which must be corrected to restore the seat 14 square to the power assembly bore. This feeler gauge is rotated around the engine block seat 14 and thus indicates the difference between the highest and lowest points on the seal 14. This difference is the amount which is needed to be grinded down by the grinding wheel 22 to achieve a properly finished surface on the seat 14.

The rotation of the entire assembly 10 must of necessity be free and easily manipulated. This requirement precludes the entanglement of the power cord. Thus, the power connection 100 to the grinding motor 30 is rotatable. The housing 112 of this rotatable connection is mounted on a central shaft 108. Mounted of this shaft and insulated from it are three spaced contact discs 106. Traveling on these discs 106 are electrical contact brushes 110. The power cable 102 connecting the entire assembly 10 to a power source, not shown, is connected to a switch 104 for actuating the grinder motor 30. By means of this switch electrical contact is made from the power source to the brushes 110 and thence to the contact disc 106. These discs 106 are connected to respective wires 114 which themselves provide power to the motor 30. Thus, the entire assembly 10 may rotate without entangling the power cord 102, the connection 100 rotating in harmony with the entire assembly 10 creating a freedom of motion which leaves the operator unimpaired to concentrate on achieving a perfectly aligned seat 14.

Lifting strap guides 45 are provided as shown in FIG. 1. A lifting strap (not shown) is inserted through the openings between the spokes of the hand wheel 72 and through the strap guide 45 to be secured to the eye bolts 44 located on the expanison disc cover 51. A strap is threaded through in this manner on both sides and lifted up by hoists as are commonly available in large engine repair shops. The initial positioning and lowering of the assembly 10 into the cylinder is done in this manner with the final adjustments and tightening to be conducted in the manner previously described.

While the invention has been described with reference to a preferred embodiment it will be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

I claim:

1. A portable grinding apparatus for the in situ refinishing of an out of square engine crankcase retainer seat and insertable in a cylinder thereof, having at least two substantially rigid positioning discs, said positioning discs being axially attached in spaced vertical arrangement to a central shaft, each of said positioning discs having a diameter closely approximating and slightly smaller than the interior diameter of said cylinder, the lower of said discs serving to initially orient and center said apparatus within said cylinder and an upper disc having expansion slits which cause the periphery of said disc to expand when said disc is forced upon a tapered portion of said central shaft, said expanded disc periphery thereby orienting and immovably securing said apparatus within said cylinder parallel to the axis of the cylinder bore, said positioning discs rigidly securing said apparatus about the periphery of said cylinder at at least one position and locating said apparatus at a fixed attitude perpendicular to the plane of the retaining seat at at least two positions about the periphery of said cylinder, a powered grinder tool rotatably attached and adjustable for vertical travel on said central shaft, for the rotation of the grinder tool about the central shaft, thereby grinding the seat to a desired depth and resulting in a finished surface on the seat substantially perpendicular to the axis of the cylinder bore.

2. The apparatus of claim 1 wherein a dust cover is mounted on said upper disc, thereby precluding the entry of dirt and other fouling substances into said expansion slits and the juncture of said tapered portion of the central shaft and said upper disc.

3. The portable grinding apparatus of claim 1 wherein said lower positioning disc has a tapered peripheral surface.

* * * * *